United States Patent [19]

Chapell

[11] 3,949,327

[45] Apr. 6, 1976

[54] WAVEGUIDE LOW PASS FILTER

[75] Inventor: Harry F. Chapell, Maynard, Mass.

[73] Assignee: Sage Laboratories, Inc., Natick, Mass.

[22] Filed: Aug. 1, 1974

[21] Appl. No.: 493,698

[52] U.S. Cl...... 333/73 W; 333/33; 333/95 R; 333/98 R

[51] Int. Cl.[2]..... H01P 1/20; H01P 3/12; H01P 5/08

[58] Field of Search... 333/73 R, 73 W, 98 R, 95 R, 333/33, 35

[56] References Cited

UNITED STATES PATENTS

| | | | |
|---|---|---|---|
| 2,747,184 | 5/1956 | Kock | 333/73 W X |
| 3,597,710 | 8/1971 | Levy | 333/73 W X |

OTHER PUBLICATIONS

Craven et al. –"IEEE Transactions on Microwave Theory and Techniques" Vol. Mtt–19, No. 3, Mar. 1971; pp. 295–307.

Craven–"Microwave Journal" Aug. 1970; pp.51–55.

*Primary Examiner*—Alfred E. Smith
*Assistant Examiner*—Marvin Nussbaum
*Attorney, Agent, or Firm*—Wolf, Greenfield & Sacks

[57] ABSTRACT

The filter may be designed from a multiple section L-C Chebyshev low pass filter prototype and is of generally ridged filter construction. The distributed shunt capacitors in the ridged section are designed to support only one mode in both the passband and primary stop band. The series inductors are calculated in accordance with evanescent mode (below cut-off) operation.

4 Claims, 7 Drawing Figures

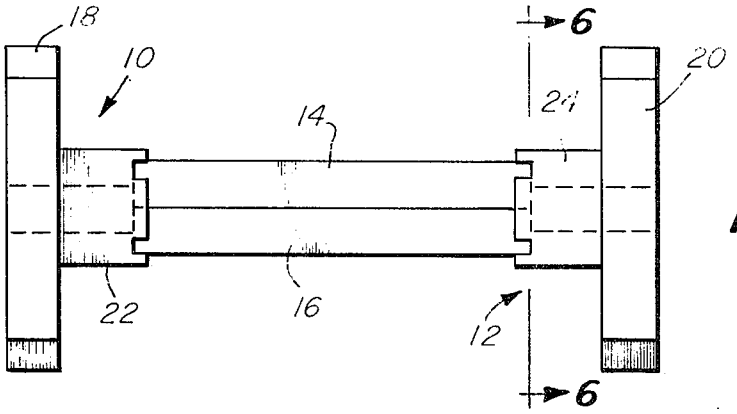
FIG. 4
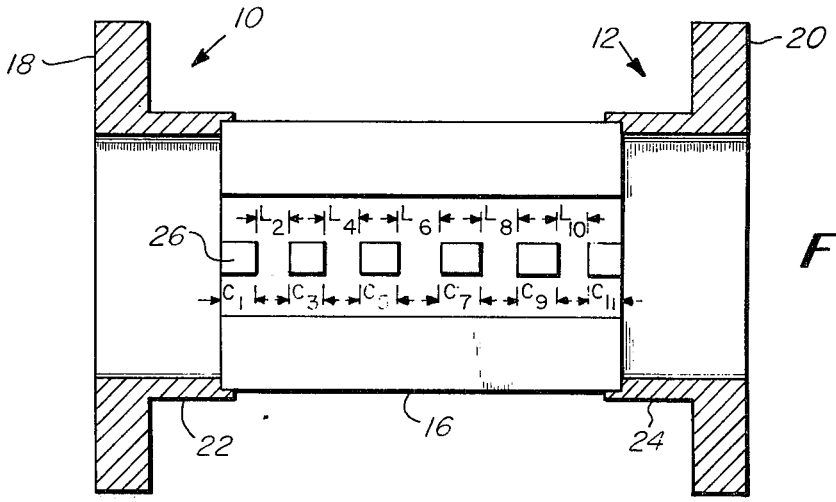
FIG. 5
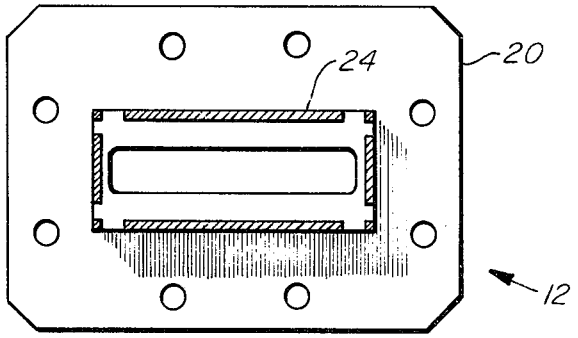
FIG. 6
FIG. 7
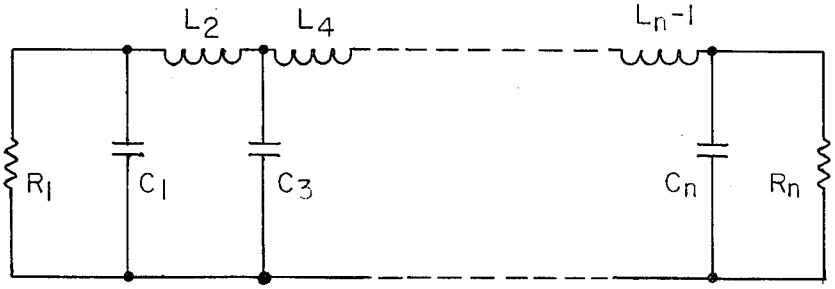

WAVEGUIDE LOW PASS FILTER

BACKGROUND OF THE INVENTION

The present invention relates in general to waveguide filters, and more particularly to an improved and relatively simple design of a waveguide low pass filter.

There presently exists various types of waveguide low pass filters. Although these structures are usually adequate for their intended use, many times they are relatively complex to fabricate and therefore expensive. There is a need for improvement to reduce the size and cost of these filters and yet improve their performance.

The use of corrugated ridge waveguides is well known. For example, one such structure is shown in Very High Frequency Techniques, Vol. II, McGraw Hill, 1947, pg. 736. This type of a filter is known to have a multitude of undesirable spurious responses. If it is desired to use the corrugated ridge waveguide in association with a standard waveguide, once again there are spurious responses that occur especially when higher order modes are excited. With these structures the gaps between the broad walls must generally be made quite small to reduce the spurious responses. This produces a low impedance structure which is difficult to match to a standard rectangular waveguide. A further reference to this structure is found in Microwave Filters, Impedance Matching Networks and Coupling Structures, by Matthaei et al., McGraw-Hill, 1964, Sec. 7.0.4.

The standard solution to spurious modes has been to provide axial slots in the structure which produces the well known "waffle filter". This type of a structure does not however improve the low impedance problem and does add to the machining cost for the structure.

Accordingly, one object of the present invention is to provide an improved waveguide low pass filter that can be fabricated relatively inexpensively and yet provide for a minimizing of spurious responses.

Another object of the present invention is to provide a low pass filter structure that can operate at moderately high average power with a very low insertion loss.

Still another object of the present invention is to provide a waveguide low pass filter that may be constructed smaller than present comparable filters such as a waffle iron filter.

SUMMARY OF THE INVENTION

To accomplish the foregoing and other objects of this invention there is provided a waveguide low pass filter which comprises a waveguide structure having a sequential capacitive ridged and inductive rectangular cross sections. The structure can be designed from an L-C lumped element prototype. The rectangular waveguide is selected for operation in the evanescent mode (below cut-off) for the desired pass band. The ridged waveguide is selected to support only one mode in both the pass band and primary stop band.

For a more thorough understanding of a device constructed in accordance with the teachings of this invention reference is made to the following detailed description taken in conjunction with the following drawings.

BRIEF DESCRIPTION OF THE DRAWINGS

FIG. 4 is a side view of the filter;

FIG. 5 is a cross-sectional view taken along line 5—5 of FIG. 2; and FIG. 6 is a cross-sectional view taken along line 6—6 of FIG. 4;

FIG. 7 shows the Chebyshev prototype circuit for the structure of FIG. 1.

DETAILED DESCRIPTION

The filter shown in FIGS. 1–6 basically comprises four interconnected sections including end sections 10 and 12, and ridged center sections 14 and 16. The end sections 10 and 12 comprise flanges 18 and 20, and sections 22 and 24, respectively.

Figure 1:
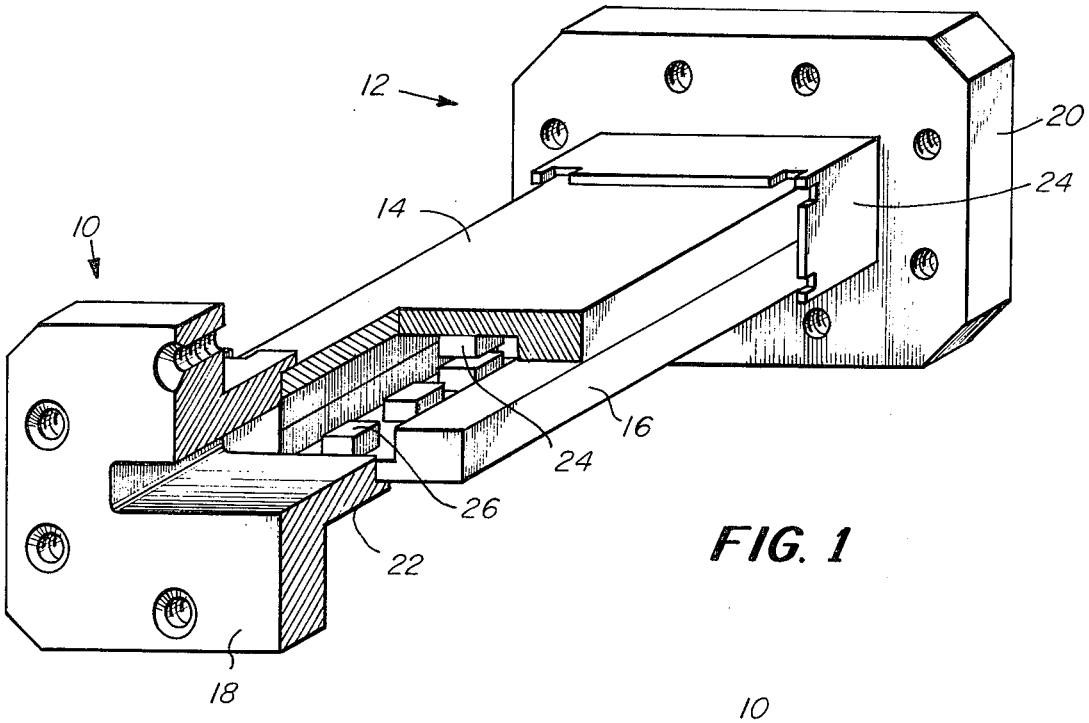
FIG. 1 is a perspective view of a filter constructed in accordance with the principles of the present invention.
Figure 2:
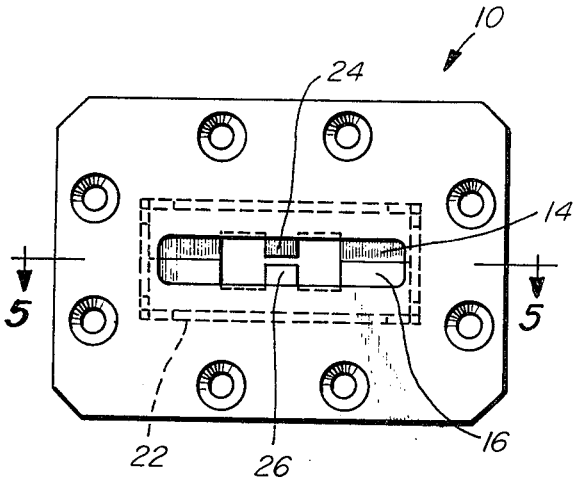
FIG. 2 is an end view of the filter shown in FIG. 1.
Figure 3:
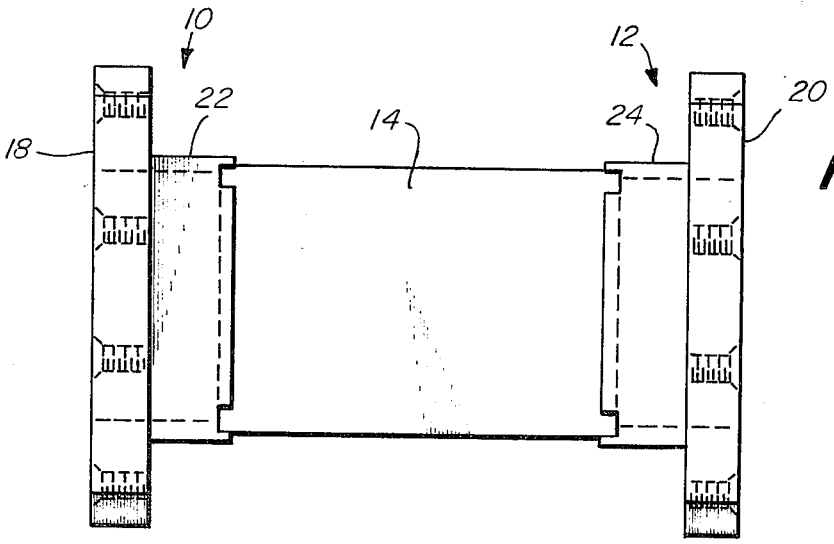
FIG. 3 is a top view of the filter.

The disclosed structure shown in FIGS. 1–6 is a double ridged structure. However, the priniciples of the present invention may also be practiced with a single ridge structure. The double ridge structure as shown in FIG. 2 includes facing ridges 24 and 26. The cross-sectional view shown in FIG. 5 depicts a series of the ridges 26.

FIG. 1 shows a perspective view of the filter of the present invention. FIG. 7 shows the prototype L-C Chebyshev circuit associated with the structure of FIG. 1.

DESIGN PROCEDURE

It can be assumed that it is desired to construct a waveguide low pass filter which is required to pass 7.23 to 7.45 gigahertz and reject 11 to 25 gigahertz. The structure should operate at moderately high average power with very little insertion loss. Other factors that may be assumed are the pass band VSWR requirement, stop-band rejection requirement, and the mating waveguide dimensions.

The first step is to select a ridge waveguide structure which has only the fundamental $TE_{10}$ mode of propagation over the pass band and stop band frequency range. If the required operating pass band is relatively wide it is advantageous to place the ridge waveguide fundamental $TE_{10}$ cut-off frequency near that of the mating waveguide. Graphs and tables of a variety of ridge waveguide cross sections may be found in Microwave Engineers Handbook, Vol. 1, Horizon House, 1971, pgs. 19–92. Intermediate the ridges is a waveguide cross section which is selected so as not to propagate in the pass band. For some requirements this cross section can be provided by simply removing the ridges from the ridge guide previously selected. This also provides an easily fabricated geometry. If the operating band that is selected does not coincide with the bands referred to in these tables, the figures appearing therein can be interpolated.

Using the specified pass band, VSWR and frequency and the stop band rejection and frequency, a normalized low pass prototype can be selected, such as the L-C Chebyshev prototype. Such a prototype is shown in the Microwave Engineers Handbook at pg. 164 and in FIG. 7.

Maximum inductor length is choosen slightly less than one-half wavelength at the highest frequency to be blocked. This determines an inductance value and establish the internal filter impedance. As previously indicated the inductor values are selected for operation below cut-off or in the evanescent mode. For calculation of these values reference is made herein to an article entitled "Design of Evanescent Mode Waveguide Band Pass Filter For a Prescribed Insertion Loss Characteristic" MTT Vol. 19, No. 3, March 1971, by Craven & Mok. This article is concerned with filtering in general wherein the entire design is in the evanescent mode. The formula and equivalent circuit described by Craven & Mok permits one to calculate the series inductance using a length $l$ which is slightly less than one-half wavelength at the highest frequency in the stopband (A spurious response is likely near the one-half wavelength frequency). The calculation is made as follows:

$$\text{series inductance} = jXo \sinh(\gamma l)$$

where $$\gamma = \frac{2\pi}{\lambda}\sqrt{\frac{\lambda^2}{\lambda_c^2} - 1}$$

and $$X_0 = 120\pi \frac{b}{a} \frac{1}{\sqrt{\frac{\lambda^2}{\lambda_c^2} - 1}}$$

The next step is to denormalize the low pass prototype using the series inductance calculated in the previous step which was for the largest inductive element. The internal impedance can be calculated from the prototype equations from the inductive value $L_k$, the cut-off frequency $\omega_c$ and the element value $g_k$, as follows:

$$L_k = \frac{R}{\omega_c} \cdot g_k \text{ or } R = \frac{L_k}{g_k} \cdot \omega_c$$

The choice of the particular low pass filter prototype effects the impedance steps. For example, a Zolotarev function prototype has significantly different element ($g$) values from the Chebyshev function prototype.

The next step is to calculate all of the other inductive values which can be determined from the $g$ values taken from the tables in the Microwave Engineers Handbook, supra. With these inductor values then the equations for evanescent mode operation can in turn, be used to calculate the lengths of the inductive sections. These lengths $l$ are shown in a specific example in Table I.

Regarding the shunt capacitors, reference is again made to the Microwave Engineers Handbook, supra, on page 164 which shows the following equation:

$$c_k = \frac{1/R}{\omega_c} \cdot g_k$$

From this equation and knowing the internal impedance R one can calculate the capacitance value. To this value there must be added a shunt inductance value taken from the Craven and Mok article, supra, referred to hereinbefore. This shunt inductance is defined by the following equation.

$$\text{shunt inductance} = jX_o \coth\left(\frac{\gamma l}{2}\right)$$

The next step is to calculate the length of the ridge waveguide sections required to provide the corrected capacitance from the previous step. Distributed element formulae are appropriate and can be found in "Microwave Filters, Impedance Matching Networks and Coupling Structures" by Matthaei et al., supra, pgs. 365–373.

There can next be calculated the matching transformers or tapers to convert from the required mating waveguide impedance to the filter impedance determined in a previous step.

This is a conventional step in that once the two impedances are known, known techniques can be used for calculating the step transformer between these impedance levels. For example, refer to Matthaei et al., supra, at pgs. 255–354. Once the filter has been constructed in accordance with the principles set forth herein above some empirical modifications may be made to account for fringing capacitance.

Table I

Design Example

| Section k | Normalized Element Values $g_k$ | Inductor Lengths $l_k$ inches | Compensated Capacitor Lengths $C_k$ inches | Empirical Optimized Lengths $l_k$ & $C_k$ |
|---|---|---|---|---|
| 1,11 | .823 | — | .065 | .150 |
| 2,10 | 1.444 | .142 | — | .142 |
| 3,9 | 1.830 | — | .158 | .164 |
| 4,8 | 1.744 | .167 | — | .167 |
| 5,7 | 1.955 | — | .178 | .178 |
| 6 | 1.786 | .172 | — | .172 |

Having explained the design procedure hereinabove, a specific example will now be given. Reference is also now made to table I shown above which is for an 11 section filter and indicates the capacitor and inductor lengths also associated with FIG. 5.

In table I, the low pass prototype element values have been normalized to 0.01 db cut-off frequency for the 11 section 0.01 db ripple filter from published tables. For convenience, the evanescent mode guide cross section was chosen at 0.230 × 0.532 inches. The guide cut-off frequency, $fc$, in inches equals $$\frac{11.8}{2 \times \text{Width}} = \frac{11.8}{2 \times .532} = 11 \text{ gHz.}$$

The filter cut-off frequency was chosen at 8 gHz to meet electrical requirements. The inductor $L_6$ is the longest inductor and was chosen to be 0.172 inches in length or slightly less than one half wavelength at 25 gHz which is the highest frequency to be blocked. The filter terminating impedance, Ro, is then given by the equation $$R_o = \frac{X_o \sinh \gamma l6}{g6} = 72 \text{ ohms}$$

$$\gamma = \frac{2\pi f}{11.8}\sqrt{\frac{f_c^2}{f^2} - 1} = 4.0 \text{ radians/inch}$$

$\gamma$ is in radians per inch, $f$ is filter cut-off frequency in gHz, = 8 gHz, $fc$ is guide cut-off frequency in gHz, = $11_1$ gHz and $Xo$ is the guide impedance given by $$X_o = 377 \frac{b}{a} \frac{1}{\sqrt{\frac{f_c^2}{f^2} - 1}} = 173 \text{ ohms}$$

where $b$ and $a$ are the guide height and width. The other inductor lengths are obtained by solving for $l_k$ using $Ro$ = 72 ohms and the appropriate value of $g_k$.

As previously mentioned in accordance with the design procedure one selects a ridge wave guide structure which has only the fundamental mode of propagation over the pass band and stop band frequency range. In the example that is given the cross section of 0.230 × 0.532 inches is obtained by interpolating between two standard 3.6:1 bandwidth doubled ridge wave guides (see page 91 of the Microwave Engineers Handbook, supra). By this interpolation there is a fundamental $TE_{10}$ cut-off frequency of 5.99GHz anad a $TE_{20}$ mode cut-off frequency of 26.1GHz. As previously indicated for the sake of simplicity the guide cross section also fits the requirements for the evanescent portion of the filter. The $TE_{01}$ frequency occurs at a wave length of approximately twice 0.230 inches, or 25.6GHz. This provides a guard band above 26GHz for all higher order modes. The 5.99GHz $TE_{10}$ cut-off is close enough to that of the matching wave guide WR112 (5.26GHz) to obtain a wide band match.

The capacitor lengths, $C_k$, in inches are obtained from the following equation:

$$C_k = g_k \times \frac{11.8}{2\pi f} \times \frac{Zc}{Ro} - \text{(step discontinuity correction)}$$

where the ridge waveguide impedance, $Zc$, from published graphs equals 48 ohms and the step discontinuity correction is estimated from experience to be 0.064 inch per step between ridge guide and evenescent mode guide.

The lengths were adjusted emperically to optimize performance. From the figures shown in Table I, the most drastic change was to $C_1$. This is attributed to the large inductor step discontinuity at the junction of the ridge waveguide and the wide rectangular waveguide transformer.

What is claimed is:

1. A waveguide low pass filter structure comprising sequential ridged waveguide capacitive and inductive sections wherein a shunt capacitance is associated with each ridge and a series inductance exists between ridges, said series inductances being selected for operation in the evanescent mode for the desired passband, and said shunt capacitance selected to support only one mode in both the passband and primary stop band.

2. The filter structure of claim 1 wherein the maximum inductor length is choosen slightly less than one-half wavelength at the highest frequency to be blocked.

3. The filter structure of claim 1 wherein the series inductance $$= j X_o \sinh(\gamma l)$$

where $$\gamma = \frac{2\pi}{\lambda} \sqrt{\frac{\lambda^2}{\lambda_c^2} - 1}$$

and $$X_o = 120\pi \frac{b}{a} \frac{1}{\sqrt{\frac{\lambda^2}{\lambda_c^2} - 1}}$$

4. The filter structure of claim 1 wherein the element values are selected from a Chebyshev function prototype.

* * * * *